US008926359B2

(12) United States Patent
de Bruijn et al.

(10) Patent No.: US 8,926,359 B2
(45) Date of Patent: Jan. 6, 2015

(54) ELECTRICAL MODULE HAVING EXTRA ELECTRICAL TERMINALS

(75) Inventors: Jeroen de Bruijn, Loon op Zand (NL); Thierry Goossens, Herdersem-Aalst (BE); Johannes Maria Blasius van Woensel, Rosmalen (NL)

(73) Assignee: FCI, Guyancourt (FR)

( * ) Notice: Subject to any disclaimer, the term of this patent is extended or adjusted under 35 U.S.C. 154(b) by 434 days.

(21) Appl. No.: 13/226,795

(22) Filed: Sep. 7, 2011

(65) Prior Publication Data

US 2012/0058669 A1 Mar. 8, 2012

Related U.S. Application Data

(60) Provisional application No. 61/380,452, filed on Sep. 7, 2010.

(51) Int. Cl.

| | |
|---|---|
| ***H01R 24/00*** | (2011.01) |
| ***H01R 9/24*** | (2006.01) |
| *H01R 12/68* | (2011.01) |

(52) U.S. Cl.
CPC . *H01R 9/24* (2013.01); *H01R 12/68* (2013.01)
USPC ..... 439/422; 439/626

(58) Field of Classification Search
CPC ..... H01R 12/62; H01R 12/82
USPC ..... 439/422, 492, 498, 499, 626
See application file for complete search history.

(56) References Cited

U.S. PATENT DOCUMENTS

| | | | |
|---|---|---|---|
| 3,612,747 | A | 10/1971 | Shlesinger, Jr. |
| D227,767 | S | 7/1973 | Gillespie |
| 4,082,402 | A | 4/1978 | Kinkaid et al. |
| 4,171,858 | A | 10/1979 | Knowles et al. |
| 4,371,225 | A | 2/1983 | Narozny |
| 4,560,226 | A | 12/1985 | Dennis |
| 4,564,253 | A | 1/1986 | Sinclair |
| 4,784,623 | A | 11/1988 | Beck, Jr. |

(Continued)

FOREIGN PATENT DOCUMENTS

| | | |
|---|---|---|
| JP | 3173702 | 1/2012 |
| TW | D116895 | 5/2007 |

(Continued)

OTHER PUBLICATIONS

International Patent Application No. PCT/US2011/050604: International Search Report and Written Opinion dated Mar. 2, 2012, 8 pages.

(Continued)

*Primary Examiner* — Briggitte R Hammond
(74) *Attorney, Agent, or Firm* — Baker & Hostetler LLP

(57) ABSTRACT

An electrical connector assembly includes an electrical connector and a module. The electrical connector includes a connector housing and a first plurality of electrical terminals supported by the connector housing. The module includes a module housing and a second plurality of electrical terminals supported by the module housing. The second plurality of electrical terminals is greater in number than the first plurality of electrical terminals, such that a first select number of the second plurality of electrical terminals is configured to mate with the first plurality of electrical terminals, and a second select number of the second plurality of electrical terminals is configured to mate with an auxiliary electrical component.

12 Claims, 8 Drawing Sheets

(56) References Cited

U.S. PATENT DOCUMENTS

| | | | | |
|---|---|---|---|---|
| 4,832,620 | A | 5/1989 | Yamamoto | |
| 4,915,650 | A * | 4/1990 | Daly et al. | 439/498 |
| 4,973,264 | A * | 11/1990 | Kamono et al. | 439/498 |
| 4,993,969 | A * | 2/1991 | Cabourne | 439/499 |
| 5,007,858 | A * | 4/1991 | Daly et al. | 439/498 |
| 5,013,247 | A * | 5/1991 | Watson | 439/55 |
| 5,567,545 | A | 10/1996 | Murakami | |
| 5,631,098 | A | 5/1997 | Suzuki | |
| D408,353 | S | 4/1999 | Yoshiura | |
| D409,143 | S | 5/1999 | Yoshiura | |
| D410,226 | S | 5/1999 | Yoshiura | |
| 5,928,029 | A * | 7/1999 | Lam | 439/497 |
| 5,967,831 | A * | 10/1999 | Yamada et al. | 439/496 |
| 6,083,059 | A | 7/2000 | Kuan | |
| 6,129,168 | A | 10/2000 | Lotito et al. | |
| 6,146,179 | A | 11/2000 | Denny et al. | |
| D447,122 | S | 8/2001 | Harasawa et al. | |
| 6,309,241 | B2 | 10/2001 | Nagai | |
| 6,315,621 | B1 | 11/2001 | Natori et al. | |
| 6,331,122 | B1 * | 12/2001 | Wu | 439/567 |
| 6,375,492 | B1 | 4/2002 | Hio | |
| D473,192 | S | 4/2003 | Ouchi et al. | |
| 6,540,559 | B1 * | 4/2003 | Kemmick et al. | 439/607.05 |
| 6,575,783 | B1 * | 6/2003 | Wu | 439/540.1 |
| D481,996 | S | 11/2003 | Kihira et al. | |
| 6,648,676 | B1 * | 11/2003 | Lee | 439/499 |
| 6,648,682 | B1 * | 11/2003 | Wu | 439/567 |
| 6,648,695 | B1 * | 11/2003 | Wu | 439/638 |
| 6,666,715 | B2 * | 12/2003 | Fujita et al. | 439/540.1 |
| D485,807 | S | 1/2004 | Kao et al. | |
| 6,719,591 | B1 * | 4/2004 | Chang | 439/638 |
| 6,755,679 | B2 | 6/2004 | Godefroy et al. | |
| 6,835,089 | B2 | 12/2004 | Hayes et al. | |
| 6,932,382 | B2 | 8/2005 | Hayes et al. | |
| 6,933,445 | B1 | 8/2005 | Duesterhoeft et al. | |
| 6,951,488 | B2 | 10/2005 | Hsieh | |
| 6,953,356 | B2 | 10/2005 | Hisamatsu et al. | |
| 7,001,205 | B2 * | 2/2006 | Godefroy et al. | 439/422 |
| D528,985 | S | 9/2006 | Peng | |
| 7,112,103 | B2 | 9/2006 | Zhang et al. | |
| D529,443 | S | 10/2006 | Chien | |
| D530,679 | S | 10/2006 | Li et al. | |
| 7,125,260 | B2 | 10/2006 | Orita et al. | |
| 7,182,608 | B2 * | 2/2007 | Soh et al. | 439/74 |
| D538,228 | S | 3/2007 | Wang et al. | |
| D555,093 | S | 11/2007 | Chien et al. | |
| D555,095 | S | 11/2007 | Ho | |
| D555,096 | S | 11/2007 | Peng | |
| D555,131 | S | 11/2007 | Kim et al. | |
| D556,131 | S | 11/2007 | Chien | |
| D556,135 | S | 11/2007 | Dwan et al. | |
| D559,180 | S | 1/2008 | Lai et al. | |
| 7,335,068 | B2 | 2/2008 | Dwan et al. | |
| 7,338,310 | B2 | 3/2008 | Kumakura | |
| D568,246 | S | 5/2008 | Wu et al. | |
| D568,248 | S | 5/2008 | Chen et al. | |
| D569,343 | S | 5/2008 | Hung et al. | |
| D569,801 | S | 5/2008 | Chuang | |
| D569,802 | S | 5/2008 | Long et al. | |
| D570,288 | S | 6/2008 | Ma et al. | |
| 7,445,518 | B2 | 11/2008 | Schneider et al. | |
| D582,348 | S | 12/2008 | Shiu | |
| D584,231 | S | 1/2009 | Wu | |
| D584,237 | S | 1/2009 | Zhu | |
| D586,294 | S | 2/2009 | Lung | |
| D596,575 | S | 7/2009 | Chen et al. | |
| 7,556,503 | B2 | 7/2009 | Vinther | |
| 7,575,439 | B2 | 8/2009 | Chen et al. | |
| 7,585,192 | B1 | 9/2009 | Lai | |
| D601,970 | S | 10/2009 | Peng et al. | |
| D601,971 | S | 10/2009 | Chen et al. | |
| 7,607,952 | B2 | 10/2009 | Tai | |
| D603,795 | S | 11/2009 | Kono | |
| D605,137 | S | 12/2009 | Yu et al. | |
| D607,834 | S | 1/2010 | Huang | |
| D607,835 | S | 1/2010 | Huang | |
| D608,295 | S | 1/2010 | Huang | |
| 7,662,507 | B2 | 2/2010 | Schwendinger et al. | |
| D614,493 | S | 4/2010 | Creed et al. | |
| D614,507 | S | 4/2010 | Lukan et al. | |
| D614,583 | S | 4/2010 | Wang | |
| D615,493 | S | 5/2010 | Kalis | |
| D615,943 | S | 5/2010 | Kang | |
| D618,173 | S | 6/2010 | Wang et al. | |
| D619,538 | S | 7/2010 | Peng | |
| D642,981 | S | 8/2011 | de Bruijn et al. | |
| D644,177 | S | 8/2011 | de Bruijn et al. | |
| D647,863 | S | 11/2011 | Su et al. | |
| D649,517 | S | 11/2011 | de Bruijn et al. | |
| D659,645 | S | 5/2012 | Kajiura et al. | |
| D659,646 | S | 5/2012 | Kajiura et al. | |
| D664,177 | S | 7/2012 | Oikawa et al. | |
| D666,151 | S | 8/2012 | Liao | |
| D666,975 | S | 9/2012 | de Bruijn et al. | |
| D668,615 | S | 10/2012 | Kajiura et al. | |
| D668,619 | S | 10/2012 | Kajiura et al. | |
| D669,859 | S | 10/2012 | Kajiura et al. | |
| D670,654 | S | 11/2012 | Kajiura et al. | |
| D671,501 | S | 11/2012 | Kajiura et al. | |
| D672,724 | S | 12/2012 | Kajiura et al. | |
| D673,913 | S | 1/2013 | Kajiura et al. | |
| 8,382,509 | B2 | 2/2013 | David et al. | |
| D685,744 | S | 7/2013 | Kajiura et al. | |
| D693,772 | S | 11/2013 | Kajiura et al. | |
| D697,871 | S | 1/2014 | de Bruijn et al. | |
| 8,702,443 | B2 | 4/2014 | Kajiura et al. | |
| 2002/0112985 | A1 | 8/2002 | Casses et al. | |
| 2004/0038121 | A1 | 2/2004 | Song et al. | |
| 2004/0137802 | A1 | 7/2004 | Wendling et al. | |
| 2005/0287865 | A1 | 12/2005 | Wang et al. | |
| 2006/0089018 | A1 | 4/2006 | Orita et al. | |
| 2007/0202737 | A1 | 8/2007 | Wei et al. | |
| 2007/0243458 | A1 | 10/2007 | Roehm et al. | |
| 2008/0026625 | A1 * | 1/2008 | Carver et al. | 439/310 |
| 2008/0193837 | A1 | 8/2008 | Lu | |
| 2009/0137136 | A1 | 5/2009 | Shen | |
| 2010/0062617 | A1 * | 3/2010 | Bang et al. | 439/61 |
| 2011/0300759 | A1 | 12/2011 | Ngo | |
| 2012/0058668 | A1 | 3/2012 | de Bruijn et al. | |
| 2012/0058669 | A1 | 3/2012 | Bruijn et al. | |
| 2012/0214347 | A1 | 8/2012 | Sass et al. | |
| 2012/0309225 | A1 | 12/2012 | Kajiura et al. | |

FOREIGN PATENT DOCUMENTS

| | | |
|---|---|---|
| TW | D126581 | 12/2008 |
| TW | D127913 | 3/2009 |
| TW | D134355 | 4/2010 |
| WO | WO 2009/069107 | 6/2009 |
| WO | WO 2012/033784 | 3/2012 |

OTHER PUBLICATIONS

U.S. Appl. No. 29/384,323, filed Jan. 28, 2011, de Bruijn et al.
U.S. Appl. No. 29/384,325, filed Jan. 28, 2011, de Bruijn et al.
U.S. Appl. No. 29/393,269, filed Jun. 1, 2011, Kameda et al.
U.S. Appl. No. 29/393,278, filed Jun. 1, 2011, Kameda et al.
U.S. Appl. No. 29/393,281, filed Jun. 1, 2011, Kameda et al.
U.S. Appl. No. 29/393,283, filed Jun. 1, 2011, Kameda et al.
Taiwanese Patent Application No. 100306483: Search Report dated Jul. 24, 2012, 8 pages.
Taiwanese Patent Application No. 100306484: Search Report dated Jul. 24, 2012, 5 pages.
Taiwanese Patent Application No. 100306485: Search Report dated Jul. 24, 2012, 5 pages.
Taiwanese Patent Application No. 100306491: Search Report dated Jul. 24, 2012, 5 pages.

* cited by examiner

ELECTRICAL MODULE HAVING EXTRA ELECTRICAL TERMINALS

CROSS-REFERENCE TO RELATED APPLICATIONS

This claims the benefit of U.S. Patent Application Ser. No. 61/380,452, filed on Sep. 7, 2010, the disclosure of which is hereby incorporated by reference as if set forth in its entirety herein.

TECHNICAL FIELD

The present disclosure relates to electrical connectors, and in particular relates to electrical terminals configured to mate with a complementary electrical connector.

BACKGROUND

Electrical connectors are configured to be mounted to a first complementary electrical component, such as a printed circuit board, a flex circuit, or the like, and an electrical module that is configured to mate with the electrical connector. The module includes a processor, power source, and other electrical components. The electrical connector and the module both conventionally include a dielectric housing and a plurality of electrically conductive terminals supported by the dielectric housing. The electrically conductive terminals of the electrical connector define respective mounting ends that are configured to electrically connect to a first complementary electrical component when the electrical connector is mounted to the first complementary electrical component, and mating ends that are disposed opposite the mounting ends and are configured to electrically connect to electrical terminals of the module.

Typically, the electrical terminals of the module are equal in number with the electrical terminals in the electrical connector to which module is mated. Accordingly, each electrical terminal of the module mates with a complementary one of the electrical terminals of the electrical connector.

SUMMARY

In accordance with one embodiment, an electrical connector assembly includes an electrical connector and a module. The electrical connector includes a connector housing and a first plurality of electrical terminals supported by the connector housing. The module includes a module housing and a second plurality of electrical terminals supported by the module housing. The second plurality of terminals is greater in number than the first plurality of electrical terminals, such that a first select number of electrical terminals of the second plurality of electrical terminals is configured to mate with the first plurality of electrical terminals, and a second select number of electrical terminals of the second plurality of electrical terminals is configured to mate with an auxiliary electrical device.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the present disclosure, the drawings show an embodiment that is presently preferred. The invention is not limited, however, to the specific instrumentalities disclosed in the drawings. In the drawings.

DETAILED DESCRIPTION

Figure 1:
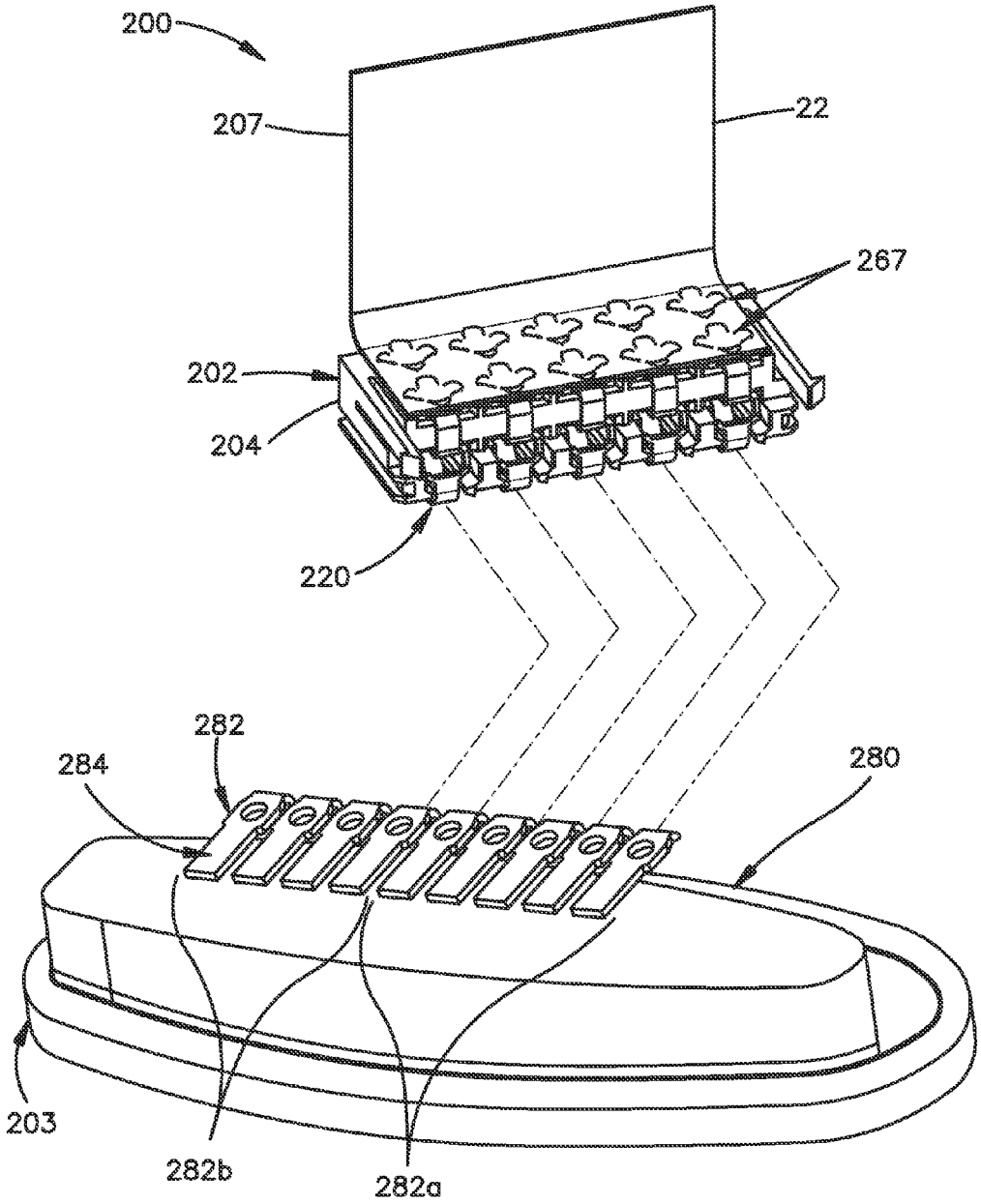
FIG. 1 is a perspective view of an electrical connector assembly including an electrical connector, a first complementary electrical device illustrated as a flat flexible cable, showing the electrical connector mounted to the flat flexible cable, and a module configured to mate with the electrical connector.
Figure 6A:
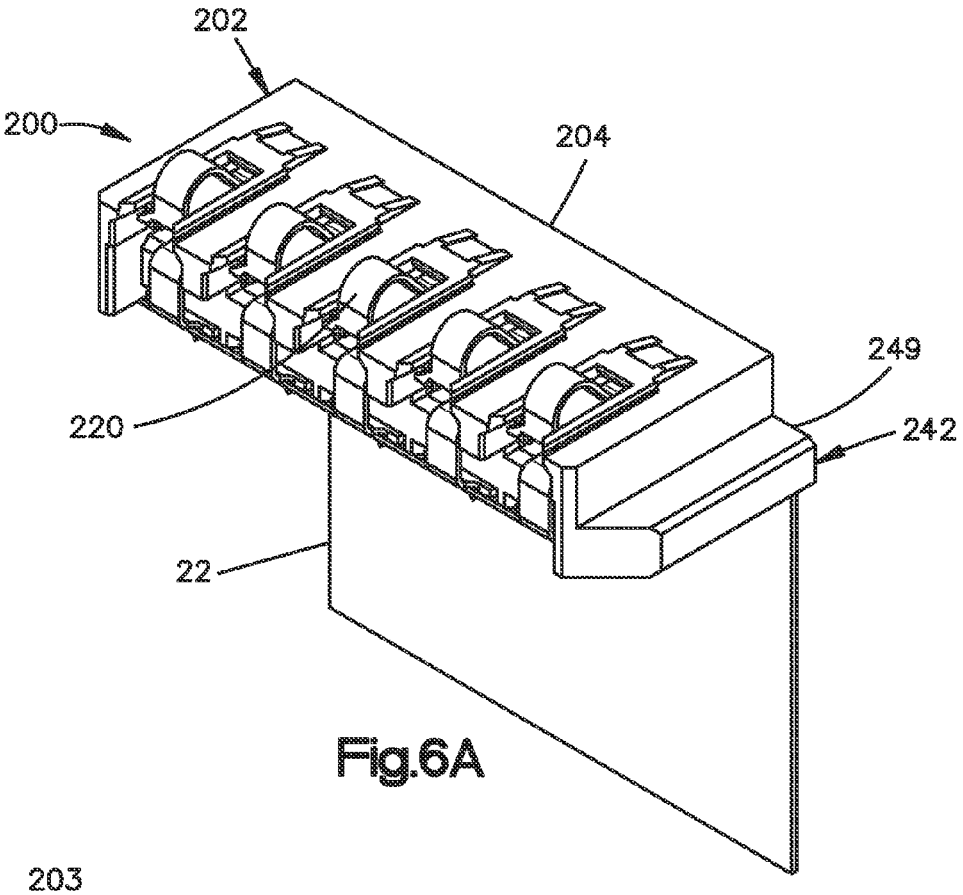
FIG. 6A is a perspective view of an electrical connector similar to the electrical connector illustrated in FIG. 1, but including a connector housing constructed in accordance with an alternative embodiment.
Figure 6B:
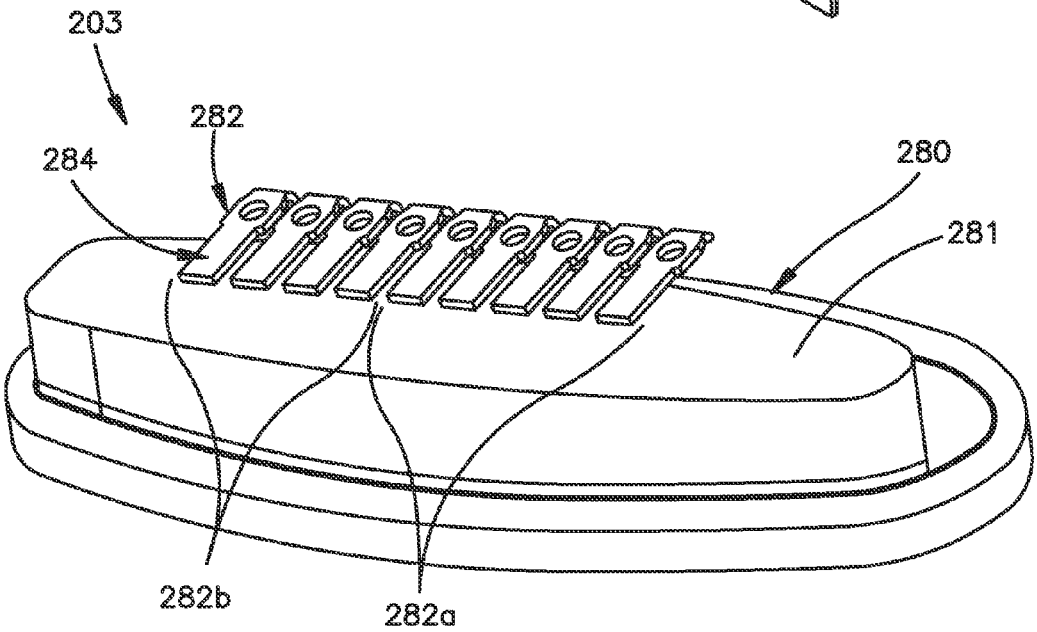
FIG. 6B is a perspective view of the module of the electrical connector assembly illustrated in FIG. 1.
Figure 6C:
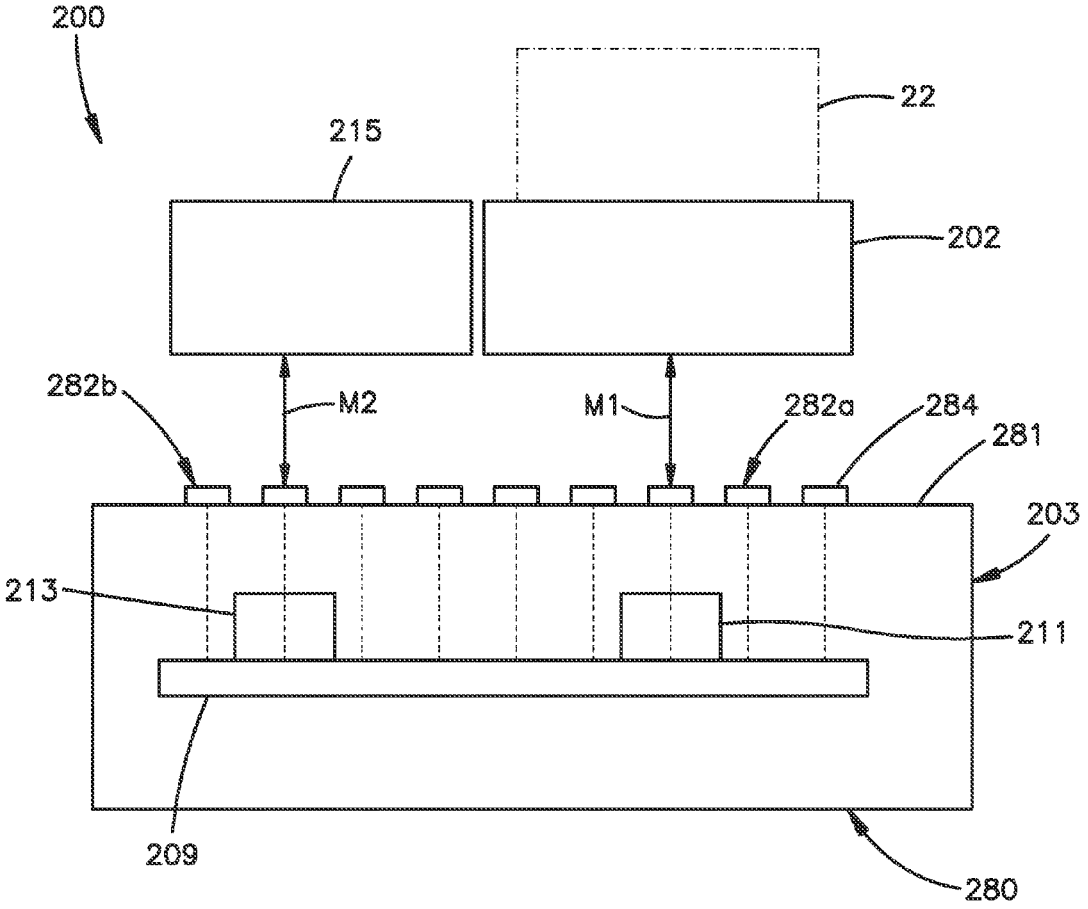
FIG. 6C is a schematic view of the electrical connector assembly illustrated in FIG. 1, showing the module mated with the electrical connector and further mated with an auxiliary electrical device.

Referring initially to FIGS. 1 and 6C, an electrical connector assembly 200 includes an electrical connector 202 and an electrical module 203 configured to be selectively mated to the electrical connector 202. Thus, the module 203 can be removable from the electrical connector 202. The electrical connector 202 is configured to be mounted to any suitable first complementary electrical device 207, which can be configured as a flat flex cable 22, which can also be referred to as a flexible printed circuit (FPC), or can be otherwise configured as desired. The module 203 includes a first electrical component 211, such as a processor, and a second electrical component 213, such as a battery. For instance, the module 203 can include a printed circuit board 209 and the first and second electrical components 211 and 213 can reside on or otherwise be electrically connected to a printed circuit board 209, such that electrical traces of the printed circuit board 209 place the first and second electrical components 211 and 213 in electrical communication with each other.

The electrical connector 202 includes a corresponding first plurality of electrical terminals 220 and the module 203 includes a second plurality of electrical terminals 284. When the electrical connector 202 and the module 203 are mated, the first plurality of electrical terminals 200 electrically connect with a select number of the second plurality of electrical terminals 284 less than all of the second plurality of electrical terminals 284, so as to establish an electrical connection between the module 203, including the processor 211, and the first complementary electrical device 207.

Figure 2A:
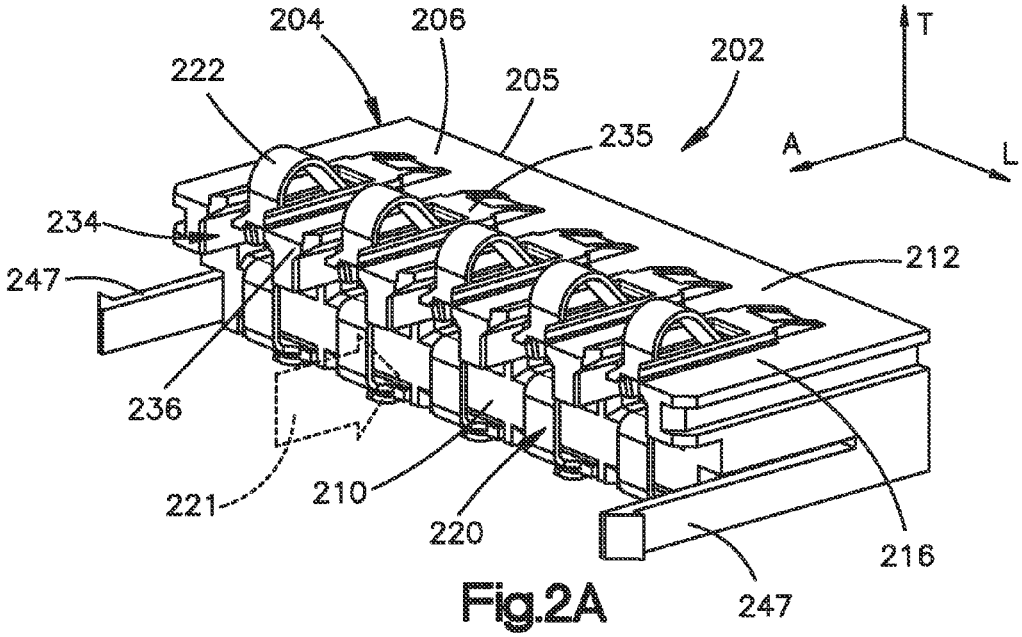
FIG. 2A is a perspective view of the electrical connector illustrated in FIG. 1, including a connector housing and a plurality of electrical terminals supported by the connector housing.
Figure 2B:
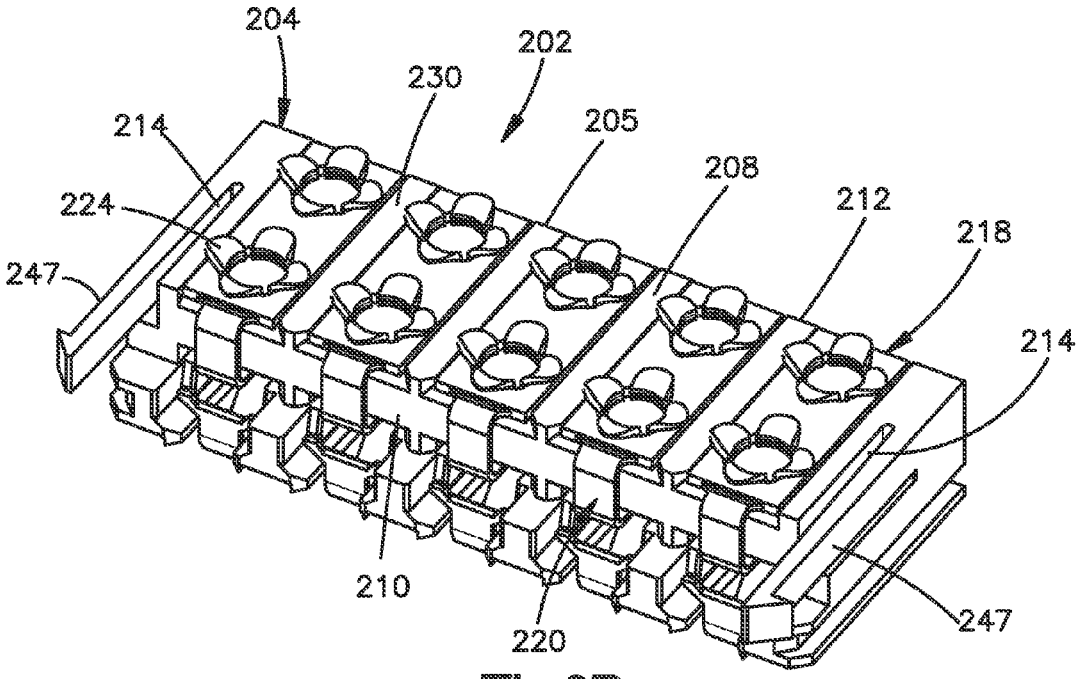
FIG. 2B is another perspective view of the electrical connector illustrated in FIG. 2A.

Referring now to FIGS. 1-2B, the electrical connector 202 includes a connector housing 204 that is dielectric or electrically insulative. The housing 204 includes a substantially rectangular housing body 205 that defines a top end 206, an opposed bottom end 208, a front end 210, an opposed rear end 212, and opposed sides 214. The opposed sides 214 are spaced apart along a first or longitudinal direction L, the front end rear ends 210 and 212 are spaced apart along a second or lateral direction A that is substantially perpendicular with respect to the longitudinal direction L, and the top and bottom ends 206 and 208 are spaced apart along a third or transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the electrical connector 202 may vary during use. In accordance with the illustrated embodiment, the connector housing 204 is illustrated as elongate in the longitudinal direction.

The connector housing 204 defines a mating interface 216 disposed proximate to the top end 206, and a mounting interface 218 that is opposite the mating interface 216 and is disposed proximate to the bottom end 208. Thus, the mating interface 216 and the mounting interface are spaced along the transverse direction T. The mounting interface 218 is configured to operatively engage the flat flex cable 22, while the mating interface 216 is configured to operatively engage the module 203 along a mating direction that can be in the transverse direction T, so as to cause the first plurality of electrical terminals 220 to mate with the select number of the second plurality of electrical terminals 284. The electrical connector 202 is illustrated as a vertical connector whereby the mating interfaces 216 is oriented substantially parallel to the mounting interface 218. Alternatively, the electrical connector 202 can be configured as a right-angle electrical connector whereby the mating interface 216 is oriented substantially perpendicular with respect to the mounting interface 218.

The electrical connector 202 includes a plurality of electrical terminals 220 that are electrically conductive and supported by the connector housing 204. The electrical terminals 220 can be installed in the connector housing 204 along a mounting direction 221 (see FIG. 2A) that can be along the lateral direction A, for instance along a rearward direction from the front end 210 to the opposed rear end 212. The electrical connector 202 can include any number of electrical terminals 220 as desired, that can be spaced along a row direction, which is the longitudinal direction L in accordance with the illustrated embodiment. The electrical terminals 220 are spaced from each other along a pitch P that is the center-to-center spacing of adjacent electrical terminals along the row direction. The electrical terminals 220 each define a mating portion 222 disposed proximate to the mating interface 216, and an opposed mounting portion 224 disposed proximate to the mounting interface 218. In particular, the mating portions 222 extend substantially in the lateral direction A along the top end 206, and the mounting portions 224 of the electrical terminals 220 extend substantially in the lateral direction A along the bottom end 208. The mounting portions 224 are configured to electrically connect to the first complementary electrical device 207 when the electrical connector 202 is mounted to the first complementary electrical device 207, and the mating portions 222 are configured to electrically connect to the complementary select number of electrical terminals 284 of the module 203.

Figure 3A:
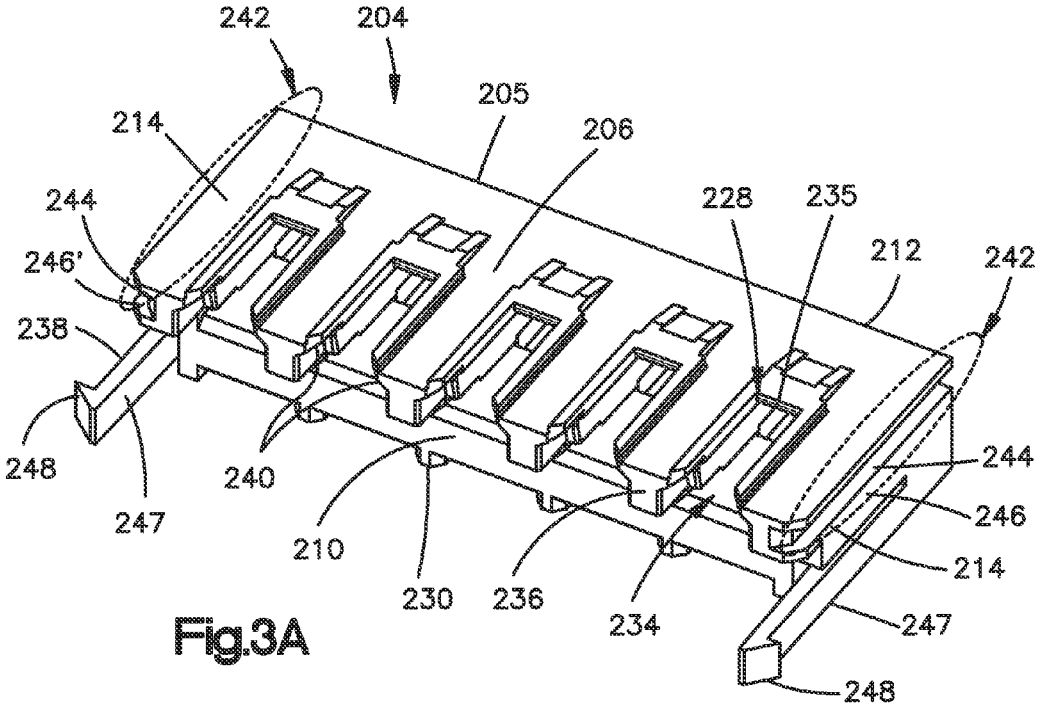
FIG. 3A is a perspective view of the connector housing of the electrical connector illustrated in FIG. 2A.
Figure 3B:
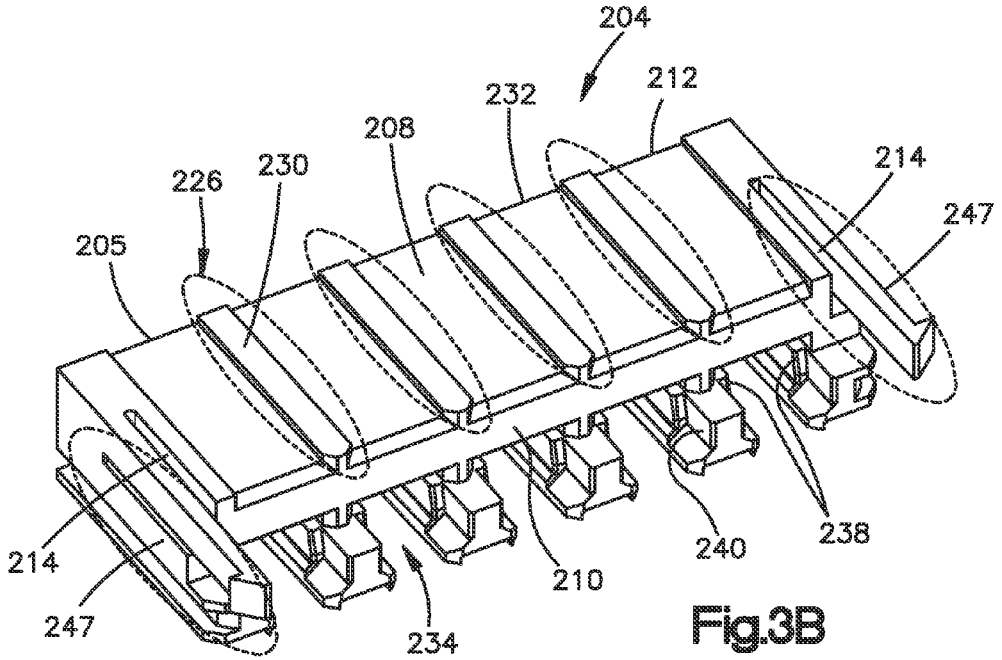
FIG. 3B is another perspective view of the connector housing illustrated in FIG. 3A.

Referring now to FIGS. 3A-B, the connector housing 204 includes a plurality of contact alignment members 226 and contact retention members 228 carried by the housing body 205. The contact alignment members 226 are configured to retain the electrical terminals 220 in a desired aligned configuration on the connector housing 204, and the contact retention members 228 are configured to retain the electrical terminals 220 in the aligned configuration. In accordance with the illustrated embodiment, the alignment members 226 are illustrated as ribs 230 that project out from the housing body 205, so as to create retention slots 232 disposed between adjacent ribs 230. In particular, the ribs 230 are illustrated as projecting transversely out, or down, from the bottom end 208 of the housing body 205. The ribs 230 are laterally elongate, and extend from the rear end 212 to the front end 210 of the housing body 205, though it should be appreciated that the ribs 230 can define any size and shape as desired. The retention slots 232 are at least partially defined by adjacent ribs 230 and the bottom end 208 of the housing body 205 and are thus recessed with respect to the transverse outer surface of the ribs 230.

The contact retention members 228 are illustrated as retention pockets 234 that extend down, transversely into, the top end 206 of the housing body 206. The housing 204 defines a plurality of divider walls 236 disposed between adjacent pockets 234. The retention pockets 234 extend laterally rearward from the front end 210 toward the rear end 212, and terminates such that the housing body 205 defines an overhang 235 that forms an upper wall of the rear end of the pockets 234. Thus, the retention pockets 234 extend under the overhang 235. The divider walls 236 can extend forward beyond the front end 210 of the housing body 205, and can further define side walls 238 that define the lateral boundaries of the retention pockets 234. The divider walls 236 can define a notch 240 that extends into the side walls 238 to facilitate initial insertion and subsequent retention of the electrical terminals 220 in the retention pockets 234.

The connector housing 204 can further include at least one engagement member 242 that is configured to engage a complementary engagement member of a complementary apparatus that can retain the electrical connector 202 in a mated configuration with a complementary electrical device. For instance, the complementary engagement member can be disposed on or carried by the complementary electrical device, or can be disposed on or carried by an auxiliary structure that engages the electrical connector 202 so as to assist in the retention of the electrical connector 202 in the mated configuration with the complementary electrical device.

As illustrated in FIGS. 3A-B, the engagement member 242 can include a pair of guide rails 244 provided as slots 246 that extend longitudinally into the opposed sides 214 of the housing body 205, and are laterally elongate between the front and rear ends 210 and 212, respectively. As illustrated, the slots 246 can extend from the rear end 212 to the front end 210. The guide rails 244 are configured to receive a complementary guide member as the electrical connector 202 is mated with the complementary electrical connector.

The engagement member 242 can further include a pair of latch arms 247 that extend forward from the housing body 205. For instance, the latch arms 247 extend forward from the opposed sides 214 at a location vertically offset from (for instance below) or alternatively vertically aligned with the guide rails 244. The latch arms 247 can define an outwardly barbed forward end 248 that is configured to engage or interlock with a complementary engagement member of the complementary apparatus so as to retain the electrical connector 202 in the mated configuration with the complementary electrical device. Alternatively, as illustrated in FIG. 6A, the engagement member 242 of the electrical connector 202 can be provided as a pair of laterally opposed guide rails 249 that extend laterally out from the sides 212 of the connector housing 204, and are elongate between the front and rear ends 210 and 212. Thus, it should be appreciated that the electrical connector 202 is illustrated in accordance with one embodiment, and the electrical connector 202 could be constructed in accordance with numerous embodiments so as to electrically connect a pair of complementary electrical devices.

Figure 4:
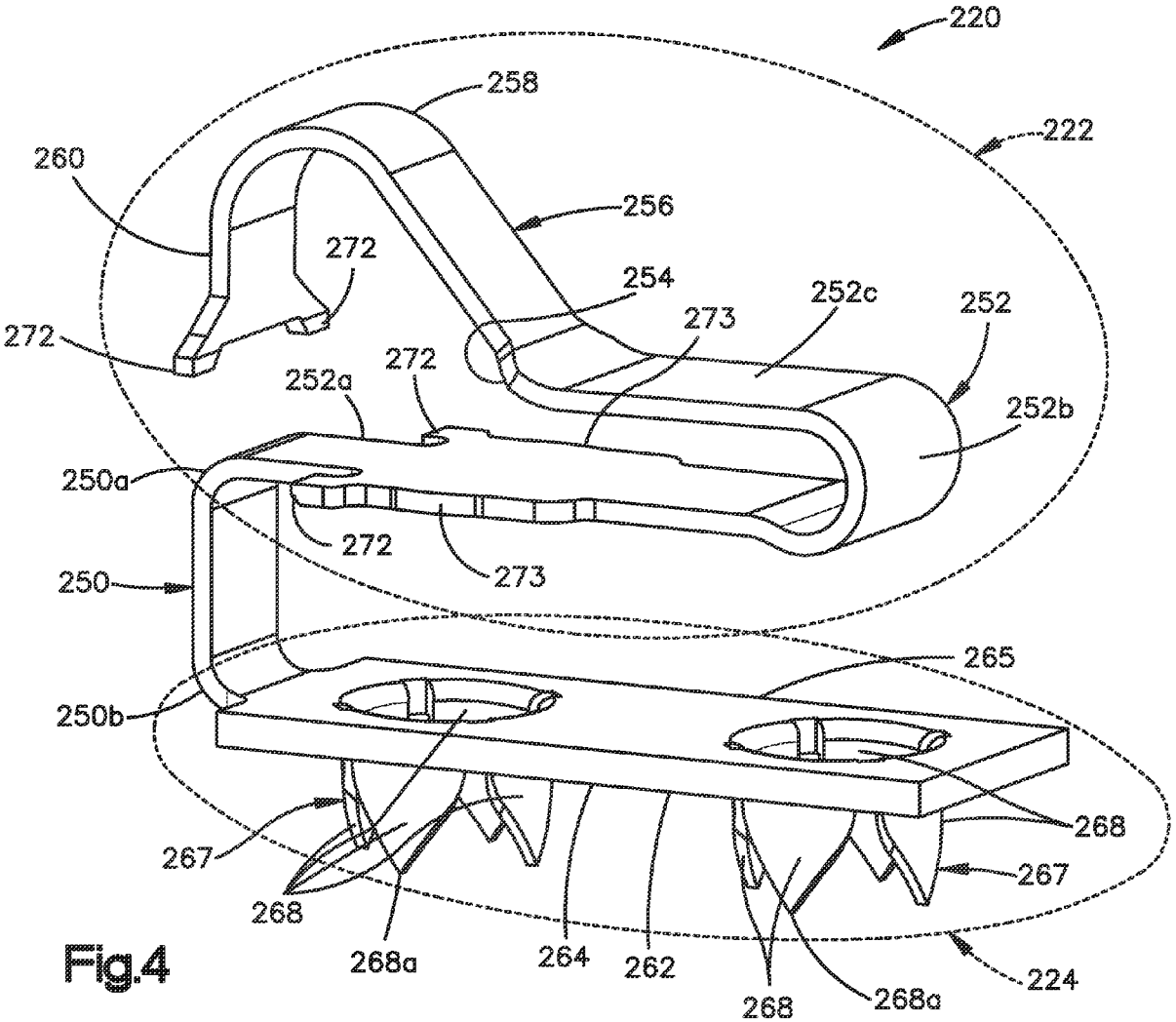
FIG. 4 is a perspective view of one of the electrical terminals of the electrical connector illustrated in FIG. 2A.

Referring now to FIG. 4, each of the electrical terminals 220 defines a mating portion 222 and a mounting portion 224, and an intermediate portion 250 connected between the mating portion 222 and the mounting portion 224. In accordance with the illustrated embodiment, the intermediate portion 250 is illustrated as a leg that extends vertically and defines a first or top end 250*a*, and an opposed second or bottom end 250*b*. The mating portion 222 extends from the top end 250*a*, and the mounting portion 224 extends from the bottom end 250*b*.

In accordance with the illustrated embodiment, the mating portion 222 includes a retention arm 252 that defines a proximal region 252*a*, a distal region 252*c*, and an intermediate region 252*b* that is connected between the proximal region 252*a* and the distal region 252*c*. The proximal region 252*a* extends laterally rearward from the top end 250*a* of the intermediate portion 250 in a direction angularly offset from the intermediate portion 250. As illustrated, the proximal region 252*a* of the mating portion 222 extends substantially perpendicular with respect to the intermediate portion 250. The intermediate region 252*b* defines a u-bend of substantially 180° from the rear end of the proximal region 252*a*. Accordingly, the distal region 252*c* extends forward from the intermediate region 252*b* along a direction substantially parallel to the proximal region 252*a* to an elbow 254, and a contact portion 256 that extends forward and transversely out from the elbow 254. The contact portion 256 is illustrated as substantially hook-shaped and defines a contact surface 258 and a distal end 260 that extends down from the contact surface 258 toward the intermediate portion 250. The distal end 260 can be substantially vertically aligned with the intermediate portion 250 as illustrated.

The mounting portion 224 is illustrated as a substantially planar mounting plate 262 that extends laterally rearward from the bottom end 250*b* of the intermediate portion 250 in a direction angularly offset from the intermediate portion 250. As illustrated, the mounting plate 262 extends substantially flat in the horizontal plane, along a direction substantially perpendicular with respect to the intermediate portion 250 and substantially parallel to the proximal region 252*a* of the mating portion 222. The mounting plate 262 defines an outer transverse or lower contact surface 264, and an opposed inner transverse or upper surface 265. The mounting plate 262 can have a transverse thickness greater than a remaining portion of the electrical terminal 220, or can have a substantially constant thickness with respect to the remaining portion of the electrical terminal 220.

The electrical terminal 220 further includes at least one crimp member 267, such as a pair of laterally spaced crimp members 267, carried by the mounting plate 266. In particular, each crimp member 267 includes a plurality of crimp teeth 268 that extend down from the contact surface 264 to a tapered distal end 268*a* in accordance with the illustrated embodiment. Thus, each crimp member 267 can extend from the mounting plate 262, for instance from the contact surface 264, along a direction that is substantially parallel to the direction in which the mating portion 222 is spaced from the mounting portion 224. For instance, each crimp member 267 can extend from the mounting plate 262 along a direction away from the mating portion 222, and thus away from the proximal and distal regions 252*a* and 252*c*, and thus further away from the contact surface 258. Alternatively, each crimp member 267 can extend from the mounting plate 262 along a direction toward the mating portion 222, and thus toward the proximal and distal regions 252*a* and 252*c*, and thus further toward the contact surface 258. The proximal region 252*a* can be disposed between the distal region 252*c* and the mounting plate 262, and thus between the distal region 252*c* and the crimp members 267. As illustrated, the crimp teeth 268 can be stamped or otherwise cut from the mounting plate 266 so as to produce an aperture 270 that extends transversely through the mounting plate 262. Alternatively, the crimp teeth 268 can be discretely attached (e.g., welded) to the mounting plate 266. Each crimp member 267 includes four crimp teeth 268 that are equidistantly spaced from each other about a transverse aperture 270 that extends through the mounting plate 266. The crimp teeth 268 are arranged such that each crimp member 267 resembles the shape of a star in accordance with the illustrated embodiment. It should be appreciated, however, that each crimp member 267 can include any number of crimp teeth 268, such as at least one crimp tooth 268, that are spaced equidistantly or variably from each other.

During operation, at least one of the electrical terminals 220 up to all of the electrical terminals 220 can be configured so as to provide a spring force that has a directional component substantially normal to the contact surface 258 at the mating portion 222. For instance, the contact surface 258 can be brought into mechanical and electrical contact with a complementary electrical terminal such that the mating portion 222 is placed in compression, thereby reliably mating the mating portion 222 to the complementary electrical terminal. For instance, when the contact surface 258, and thus the distal region 252*c*, receives a force in the transverse direction T toward the proximal region 252*a* and thus toward the mounting portion 224 (for instance applied by the complementary electrical terminal), the intermediate bent region 252*b* flexes such that the distal region 252*c* compresses along the transverse direction T toward the proximal region 252*a*, and thus toward the mounting portion 224. When the crimp members 267 extend from the mounting plate 262 along a direction away from the mating portion 222, and thus away from the proximal and distal regions 252*a* and 252*c*, and thus further away from the contact surface 258, then the proximal region 252*a* flexes along a direction that is substantially the same as a direction from which the crimp members 267 extend out from the mounting plate 262. When the crimp members 267 extend from the mounting plate 262 along a direction toward the mating portion 222, and thus toward the proximal and distal regions 252*a* and 252*c*, and thus further toward the contact surface 258, then the proximal region 252*a* flexes along a direction that is substantially the opposite a direction from which the crimp members 267 extend out from the mounting plate 262.

Referring again to FIGS. 2A-B and FIG. 4, the electrical connector 202 can be assembled by attaching the electrical terminals 220 to the connector housing 204. For instance, electrical terminals 220 are first aligned with a corresponding one of the retention slots 232 and an aligned one of the retention pockets 234. Next, each electrical terminal 220 is mounted onto the connector housing such that the front end 210 of the connector housing 204 is received in a gap disposed between the mounting plate 262 and the proximal end 252*a* of the retention arm 252. The mounting plate 262 is received in the aligned retention slot 232, and the retention arm 252 is received in the aligned retention pocket 234. The electrical terminal 220 is translated rearward with respect to the connector housing 204 until the intermediate region 252*b* abuts the front end of the housing body 205.

When the electrical terminals 220 are mounted onto the connector housing 204, the mounting plate 262 of each terminal is disposed in the aligned retention slot 232, and the retention arm 252 is received in the aligned retention pockets 234. The outer transverse surfaces of the proximal and distal regions 252*a* and 252*b* of the retention arm 252 can define a transverse thickness that is slightly less than that of the retention pocket 234 at a location under the overhang 235, such that the retention arm 252 can be press-fit into the retention pocket 234.

Furthermore, each electrical terminal 220 can include at least one retention member 271 configured to secure the electrical terminals 220 on the connector housing 204. For instance, the retention member 271 can include a first group of one or more tangs 272 that protrude laterally outward, for instance from the proximal regions 252*a* of the retention arm 252. The tangs 272 are configured to be press-fit in the side walls 238, for instance in the notches 240. The retention member can further include a projection 273 that extends out from the proximal regions 252*a* at a location rearward with respect to the tangs 272. The projections 273 can extend laterally outward to a location that is recessed with respect to that of the tangs 272, such that the projections can be press-fit against the side walls 238 at a location rearward of the notches 240. The retention member 271 can further include a second group of one or more tangs 272 that protrude obliquely out from the distal end 260 of the contact portion 256. The tangs 272 can also be press-fit against the side walls 238 as desired. Additionally, the rear ends of the proximal and distal regions 252*a* and 252*c* of the retention arm 252, along with the intermediate region 252*b*, can be press-fit under the overhang 235, such that the proximal and distal regions 252*a* and 252*c* are compressed between the overhang 235 and the base of the pocket 234. While the electrical terminal 220 has been described in accordance with the illustrated embodiment, it should be appreciated that the electrical terminals 220 can assume any suitable alternative size and shape as desired. It should be appreciated that the proximal region 252*a*, including the retention member, can be disposed over and overlap the mounting portion 224, including the crimp members 267. Furthermore, the distal region 252*c*, including the contact surface 258, can be disposed over and overlap the proximal region 252*a*, including the retention member, and can further be disposed over and overlap the mounting portion 224, including the crimp members 267.

The electrical terminals 220 can be mounted on the connector housing 204, such that the mating portions 222 of the terminals 220 are configured to be placed in electrical communication with a complementary electrical device, which can be any device as desired such as a sensor or processor, or can alternatively be a complementary electrical connector such as the module 203, which in turn can be mounted to, and thus electrically connected to, another electrical device, such as a sensor or processor. The mating portions 222 can be compliant, so as to be spring biased in contact with complementary electrical terminals of the complementary electrical device.

Figure 5A:
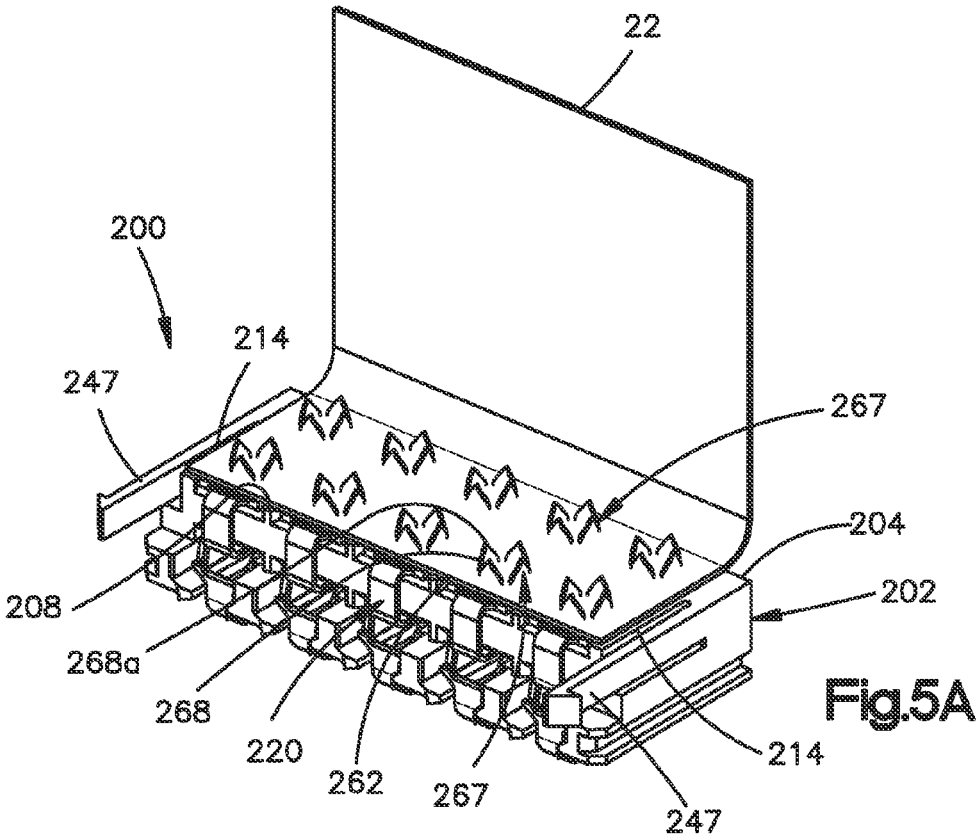
FIG. 5A is a perspective view of a portion of the electrical connector assembly illustrated in FIG. 1, showing the electrical connector mounted to the flat flexible cable in an uncrimped configuration.
Figure 5B:
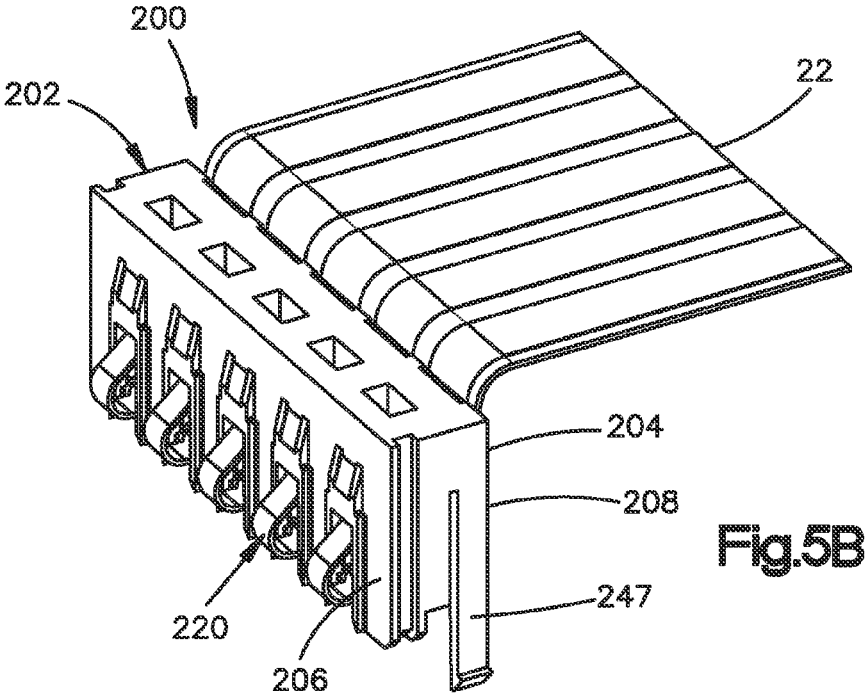
FIG. 5B is another perspective view of the portion of the electrical connector assembly illustrated in FIG. 5A.

Referring now to FIGS. 2A-B and 5A-B, the mounting portions 224 can be electrically connected to the flat flex cable 22 by crimping the crimp teeth 268 onto the flat flex cable 22, thereby placing the electrical terminals 220 in electrical communication with the electrical traces that run through the flat flex cable 22. For instance, the flat flex cable 22 can be placed against the bottom end 208 of the connector housing 204 such that the crimp teeth 268 pierce through the flat flex cable 22 along a first direction as shown in FIG. 5A. Next, the crimp member 267 can be stamped with a die, which is brought against the crimp teeth 268, causing the crimp teeth 268 to fold back along a second direction that is substantially opposite the first direction such that the tapered distal ends 268*a* pierce the flat flex cable 22 and contact the traces running therethrough (see FIG. 1). The stamping operation can cause the crimp teeth 268 to fold outward or inward as desired. Thus, as the die is brought into contact with the crimp teeth 268, the bottom end 208 of the connector housing 204 can provide a mandrel that supports the stamping operation.

In order to reduce the forces on the connector housing 204 during the stamping operation, the connector housing 204 can be reinforced with a plate or any suitable structure if desired to provide structural support to the integrity of the connector housing 204. Alternatively, the crimp member 267 can be stamped so as to cause the crimp teeth 268 to crimp against the flat flex cable 22 when the mounting plates 262 extend away from the connector housing 204, and the electrical terminals 220 can be folded so as to bring the mounting plates 262 toward and against the connector housing 204 after the crimp teeth 268 have been mounted to the flat flex cable 22. For instance, the mounting portion 224, and thus the mounting plate 262 can extend out from the connector housing 204 during the stamping operation, such that the second surface 265 is braced against a support, such as a first die. The flat flex cable 22 can be placed adjacent the crimp teeth 268, for instance adjacent the tapered distal ends 268*a*, and brought against the crimp teeth 268 such that the crimp teeth 268 pierce the flat flex cable 22 and extend through the flat flex cable. A second die can be positioned adjacent the crimp teeth 268, such that the flat flex cable 22 and the mounting portion 224 are disposed between the first and second dies. The first and second dies can then be brought toward each other after the crimp teeth 268 have pierced through the flat flex cable 22, thereby causing the crimp teeth 268 to fold back toward the flat flex cable 22 such that the tapered distal ends 268*a* are embedded in the flat flex cable 22. The crimp teeth 268 can have any height when uncrimped as desired, it being appreciated that as the height of the crimp teeth 268 increases, the crimp teeth 268 can be crimped against the flat flex cable 22 under reduced stamping forces that are applied against the connector housing 204.

Thus, crimping the crimp teeth 268 against the flat flex cable 22 causes the electrical terminals 220 to place the complementary electrical device that is mated to the mating portions 222 of the electrical terminals 220 in electrical communication with the flat flex cable 22. The flat flex cable 22 can thus define a first end that is mounted onto mounting portions 224 of the terminals, and an opposed second end that is electrically connected to a complementary electrical device, such as a sensor or a processor. Thus, the flat flex cable 22 can place a processor in electrical communication with the mounting portions 224 of the electrical terminals 220 and the mating portions 222 can be electrically connected to a sensor, either direction or via a module, such as the module 203. Conversely, the flat flex cable 22 can place a sensor in electrical communication with the mounting portions 224 of the electrical terminals 220 and the mating portions 222 can be electrically connected to a processor, either direction or via a module, such as the module 203.

Referring now to FIGS. 1 and 6B-C, the module 203 includes a dielectric or electrically insulative module housing 280 and a second plurality of electrical terminals 282 that is supported by the module housing 280. The module housing 280 defines a mating interface 281 that is configured to mate with the electrical connector 202 and is further configured to mate, for instance simultaneously, with an auxiliary electrical device 215 that is separate from the electrical connector 202. The electrical terminals 282 define respective mating portions 284 disposed proximate to the mating interface 281. In accordance with the illustrated embodiment, the module 203 includes a greater number of electrical terminals 282 compared to the number of electrical terminals 220 of the electrical connector 202. Thus, the electrical terminals 282 include a first select number of electrical terminals 282*a* that are configured to mate at the respective mating portions 284 with, and thus electrically connect to, the electrical terminals 220. The first select number of electrical terminals 282*a* can be in electrical communication with the first electrical component 211, and the second select number of electrical terminals 282*b* (which are different than the first select number of electrical terminals 282*a*) can be in electrical communication with the second electrical component 213. In accordance with one embodiment, at least some up to all of the first select number of electrical terminals 282*a* are configured as data transmission terminals, and at least some up to all of the second select number of electrical terminals 282*b* can be configured as electrical power transmission terminals. Thus, the electrical terminals 282 can be in electrical communication with electrical traces of the printed circuit board 209, such that the first select number of electrical terminals 282*a* are in electrical communication with the first electrical component 211, and the second select number of electrical terminals 282*b* are in electrical communication with the second electrical component 213.

Thus, the electrical terminals 282 include the second select number of electrical terminals 282*b* that define an extra number of terminals that do not mate with the electrical terminals 220 of the electrical connector 202 when the module 203 is mated with the electrical connector 202. Instead, the second number of electrical terminals 282*b* are configured to removably electrically connect at their respective mating portions 284 to an auxiliary electrical device 215, for instance while the first number of electrical terminals 282*a* are mated with the electrical terminals 220 of the electrical connector 202, or while the first number of electrical terminals 282*a* are not mated with the electrical terminals 220 of the electrical connector 202. Thus, the module 203 is configured to place the electrical connector 202 in electrical communication with the first electrical component 211, which can be a processor, and is further configured to place the auxiliary electrical device 215 in electrical communication with the second electrical component 213, which can be a battery or other rechargeable power source. In accordance with one embodiment, the second electrical component 213 can be configured to supply electrical power to the first electrical component 211. The auxiliary electrical device 215 can be configured as a battery charger that is configured to supply a charge to the rechargeable battery when the auxiliary electrical device 215 is placed in electrical communication with the second select number of electrical terminals 282*b*, and is thus placed in electrical communication with the second electrical component 213. For instance, during operation, the battery charger can selectively be mated with the mating portions 284 of the first select number of electrical terminals 282*a* so as to place the battery charger in electrical communication with the battery of the module 203 that powers the processor of the module 203.

Thus, the mating portions 284 of the first select number of electrical terminals 282*a* can be dedicated to mate, or electrically connect, with the electrical connector 202, and the mating portions 284 of the second select number of electrical terminals 282*b* can be dedicated to mate, or electrically connect, with the auxiliary electrical device 215. Thus, the module 203 is configured to place the first electrical component 211 in electrical communication with the electrical connector 202, and the module 203 is further configured to selectively place the second electrical component 213 (e.g., battery) in electrical communication with the auxiliary electrical device (e.g., battery charger) 215.

Thus, when the electrical connector 202 and the module 203 are mated, the first complementary electrical device, such as the flat flex cable 22 that is connected to the mounting portions 224 of the electrical terminals 220 of the electrical connector 202, can transmit signals via the first electrical connector 202 to the first electrical component 211 of the module 203. When the first electrical connector 202 and the module 203 are unmated, or while the first electrical connector 202 and the module 203 are mated, the module 203 mate with the auxiliary electrical device 215, such as a battery charger that supplies a charge to the second electrical component, by placing the mating portions 284 of the second select ones of electrical terminals 282*b* in electrical communication with the auxiliary electrical device 215. The mating portions 284 of the second number of electrical terminals 282*b* can be unmated from the auxiliary electrical device 215 so as to discontinue the charge to the battery that is mounted to the second number of electrical terminals 282*b*.

Figure 6D:
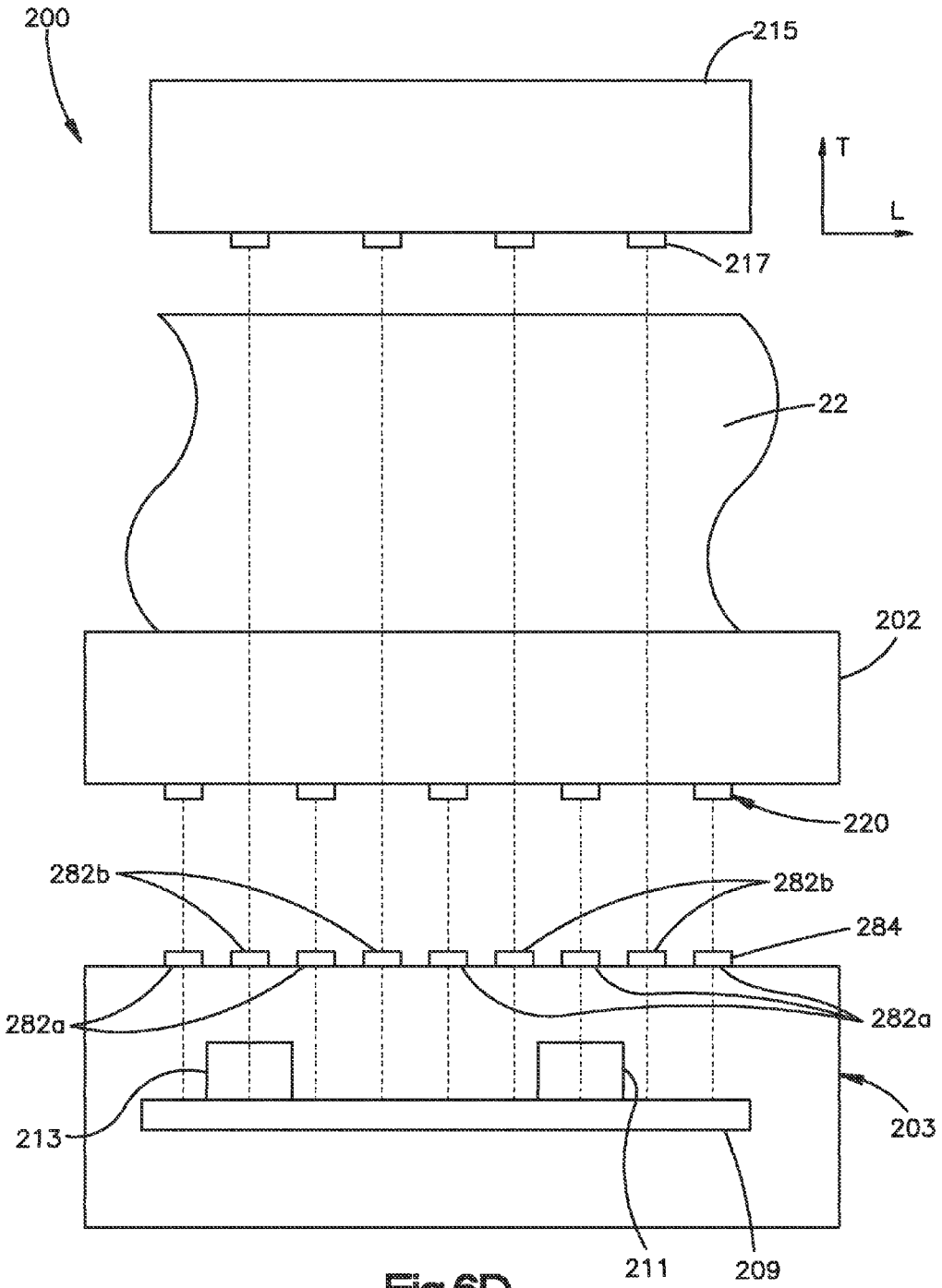
FIG. 6D is a schematic view of the electrical connector assembly similar to FIG. 6C, but constructed in accordance with an alternative embodiment.

The first select number of electrical terminals 282*b* can thus be numerically equal to the first plurality of electrical terminals 220 of the electrical connector 202. The second select number of electrical terminals 282*b* can include at least one or more, up to all, of the remaining electrical terminals 282, and can be numerically equal to the electrical terminals of the auxiliary electrical device 215. The second select number of electrical terminals 282*b* can be consecutively arranged adjacent to one longitudinal side of the first select number of electrical terminals 282*a*, which can also be consecutively arranged. Alternatively, the second select number of electrical terminals 282*b* can be disposed on opposed sides of the first select number of electrical terminals 282*a* or otherwise arranged as desired. For instance, as illustrated in FIG. 6D, ones of the first and second select number of electrical terminals 282*a* and 282*b* can be alternatingly arranged, for instance along the longitudinal direction L. Thus, the electrical terminals 217 of the auxiliary electrical device 215 that mate with the mating portions 284 of the second select number of electrical terminals 282*b* can be spaced at a pitch (which can be the distance between the center of adjacent electrical terminals) that is greater than (for instance double) the pitch of the electrical terminals 282 of the module 203. Likewise, the electrical terminals 220 of the electrical connector 202 that mate with the mating portions 284 of the first select number of electrical terminals 282*a* can be spaced at a pitch that is greater than (for instance double) the pitch of the electrical terminals 282 of the module 203. Thus, each of the first select number of electrical terminals 282*a* can be spaced at a pitch that is double the pitch of the electrical terminals 282, and each of the second select number of electrical terminals 282*b* can be spaced at a pitch that is double the pitch of the electrical terminals 282.

In accordance with the illustrated embodiment, the electrical connector 202 includes five electrical terminals 220, and the module 203 includes nine electrical terminals 282. For instance, the first select number of electrical terminals 282*a* can include five electrical terminals or any alternative number of electrical terminals as desired, and the second select number of electrical terminals 282*b* can include four electrical terminals or any alternative number of electrical terminals as desired. The module 203 is thus easily mate-able along the direction of arrows M1 and M2, respectively, and unmateable along a direction opposite M1 and M2, respectively, between the electrical connector 202 and the auxiliary electrical device 215, for instance when the electrical connector assembly 200 is located remote from a power source during use. It should be appreciated in an alternative embodiment that one or more of the first select number of electrical terminals 282*a*, along with one or more up to all of the second select number of electrical terminals 282*b*, can further be configured to mate with the auxiliary electrical device 215. One or more up to all of the second select number of electrical terminals 282*b* can be configured as electrical power terminals as described above, or can be configured as data transmission terminals as will now be described.

For instance, while the second electrical component 213 can be configured as a rechargeable power source such as a battery that is in electrical communication with the first electrical component 211 so as to supply power to the first electrical component 211, the second electrical component 213 can alternatively be configured as a data transmission interface, for instance a USB interface, that is in electrical communication with the first electrical component 211. The second electrical component 211 configured as a data transmission interface can be in electrical communication with one or more up to all of the second select ones of electrical terminals 282*b*, which can be configured as data transmission terminals. Thus, the auxiliary electrical device 215 can include a USB plug or any alternatively data transmission conduit that can receive data information that is communicated from the first electrical component 211 to the second electrical component 213, and communicate the received data information to a remote computer for further analysis and storage. Alternatively still, the second number of electrical terminals 282*b* can include power terminals that are in electrical communication with a rechargeable power source of the module 203 to recharge the rechargeable power source, and can further include data transmission terminals that are in electrical communication with a data transmission interface of the module 203.

The electrical terminals 282 can be disposed in a fixed spatial relationship with respect to an engagement member that is configured to engage the engagement member 242 of the electrical connector 202, such that the electrical terminals 282 and 220 can be mated in the manner described above. For instance, the module housing 280 can carry the engagement member, or any suitable structure that supports the module housing 280 can carry the engagement member. The engagement member can be configured as a slot that receives the guide rail 249 (FIG. 6A), a catch member configured engage the barbed forward end 248 of the latch arms 247 (FIGS. 3A-B), or any alternatively constructed engagement member configured to engage the engagement member 242 of the electrical connector 202 so as to secure the electrical connectors 202 and 203 in their mated configuration.

In accordance with one embodiment, a method cam be provided for of transmitting data of a module, such as the module 203, of the type including a module housing, such as the module housing 280, a first select number of electrical terminals, such as the first select number of electrical terminals 282*a*, that are supported by the module housing 204, and a second select number of electrical terminals, such as the second select number of electrical terminals 282*b*, of the module housing 280. The second select number of electrical terminals 282*b* are different than the first select number of electrical terminals 282*a*. The method can include the step of placing the first select number of electrical terminals 282*a* in removable electrical communication with an electrical connector, such as the electrical connector 202, that is mounted to a complementary electrical device, such as the first complementary electrical device 22, so as to place the complementary electrical device 22 in electrical communication with a first electrical component, such as the first electrical component 211, of the module 203. The method can further include the step of placing the second select number of electrical terminals 282*b* in removable electrical communication with an auxiliary electrical device, such as the auxiliary electrical device 215, so as to place the auxiliary electrical device 215 in electrical communication with a second electrical component, such as the second electrical component 213, of the module 203, wherein the second electrical component 213 of the module 203 is in electrical communication with the first electrical component 211 of the module 203. In one embodiment, the second placing step can be performed while the first select number of electrical terminals 282*a* are electrically connected with the electrical connector 202. In another embodiment, the method can include the step of removing the first select number of electrical terminals 282*a* from electrical communication with the electrical connector 202 prior to performing the second placing step. The second electrical component 213 can comprise a rechargeable power source that supplies electrical power to the first electrical component 211, the auxiliary electrical device 215 can comprises a battery charger, and the second placing step can comprise supplying an electrical charge to the rechargeable power source so as to recharge the rechargeable power source.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector assembly comprising:

an electrical connector including a connector housing and a first plurality of electrical terminals supported by the connector housing; and a module including 1) a module housing, 2) a second plurality of electrical terminals supported by the module housing, the second plurality of terminals greater in number than the first plurality of electrical terminals, such that a first select number of electrical terminals of the second plurality of electrical terminals is configured to mate with the first plurality of electrical terminals, and a second select number of electrical terminals of the second plurality of electrical terminals is configured to mate with an auxiliary electrical device that is separate from the electrical connector, 3) a processor in electrical communication with the first select number of electrical terminals, and 4) a second electrical component configured as one of a data transmission interface that receives data from the processor, and a rechargeable power source that supplies electrical power to the processor, wherein the second electrical component is in electrical communication with the second select number of electrical terminals.

2. The electrical connector assembly as recited in claim 1, wherein the first select number of electrical terminals are numerically equal to the first plurality of electrical terminals.

3. The electrical connector assembly as recited in claim 1, further comprising the auxiliary electrical device that includes at least one of a battery charger and a data transmission conduit.

4. The electrical connector assembly as recited in claim 1, wherein the second select number of electrical terminals mates with the auxiliary electrical device while the first select number of electrical terminals are mated with the electrical connector.

5. The electrical connector assembly as recited in claim 1, wherein each of the first select number of electrical terminals are consecutively arranged, and each of the second select number of electrical terminals are consecutively arranged adjacent the first select number of electrical terminals.

6. The electrical connector assembly as recited in claim 1, wherein the first select number of electrical terminals are alternatingly arranged with the second select number of electrical terminals.

7. The electrical connector assembly as recited in claim 1, wherein the electrical connector is configured to be mounted to a first complementary electrical device, such that the processor receives data signals from the first complementary electrical device.

8. The electrical connector assembly as recited in claim 7, wherein the second number of electrical terminals comprises electrical data transmission terminals.

9. The electrical connector assembly as recited in claim 7, wherein the first complementary electrical device comprises a flat flex cable, and the first select number of electrical terminals includes at least one crimp member that pierces the flat flex cable so as to mount the electrical connector to the flat flex cable.

10. The electrical connector assembly as recited in claim 7, wherein the second number of electrical terminals comprises electrical power terminals.

11. The electrical connector assembly as recited in claim 10, wherein the auxiliary electrical device is a battery charger and the second electrical component comprises rechargeable power source that supplies electrical power to the first electrical component.

12. The electrical connector assembly as recited in claim 10, wherein the second electrical component comprises the data transmission interface that receives data from the first electrical component.

* * * * *